United States Patent [19]

Brandis et al.

[11] 4,060,431

[45] Nov. 29, 1977

[54] HEAT-TREATABLE STEEL

[75] Inventors: Helmut Brandis; Albert Von Den Steinen, both of Krefeld; Serosh Engineer, Tonisvorst, all of Germany

[73] Assignee: Thyssen Edelstahlwerke Aktiengesellschaft, Krefeld, Germany

[21] Appl. No.: 715,203

[22] Filed: Aug. 17, 1976

[30] Foreign Application Priority Data

Aug. 23, 1975 Germany ..... 2537702

[51] Int. Cl.[2] ..... C22C 38/24; C22C 38/26

[52] U.S. Cl. ..... 148/36; 75/126 F; 148/143

[58] Field of Search ..... 148/12 F, 134, 143, 148/144, 36, 12.4; 75/126 F

[56] References Cited

U.S. PATENT DOCUMENTS

| | | | |
|---|---|---|---|
| 3,432,368 | 3/1969 | Nakamura | 148/12 F |
| 3,574,602 | 4/1971 | Gondo et al. | 75/126 F |
| 3,726,724 | 4/1973 | Davies et al. | 148/36 |
| 3,806,378 | 4/1974 | Bramfitt | 148/12 F |
| 3,900,347 | 8/1975 | Lorenzotti et al. | 148/36 |

OTHER PUBLICATIONS

Metals Handbook, ASM, 1961, pp. 108–111.

*Primary Examiner*—Arthur J. Steiner
*Attorney, Agent, or Firm*—Cushman, Darby & Cushman

[57] ABSTRACT

Parts made of a heat-treated alloy steel having a minimum tensile strength of 700 N/mm² and a notch toughness of at least 55 joules, wherein the alloy steel is a Mn/Cr/Nb alloy steel of lower alloy content than has hitherto been used to provide the desired strength-/toughness properties.

2 Claims, 3 Drawing Figures

COMPARISON OF STRENGTHS OF MPS AND 30 CrNiMo 8

DIAMETER: ⌀ 20 mm; TEST TEMP. RT

Figure 1:
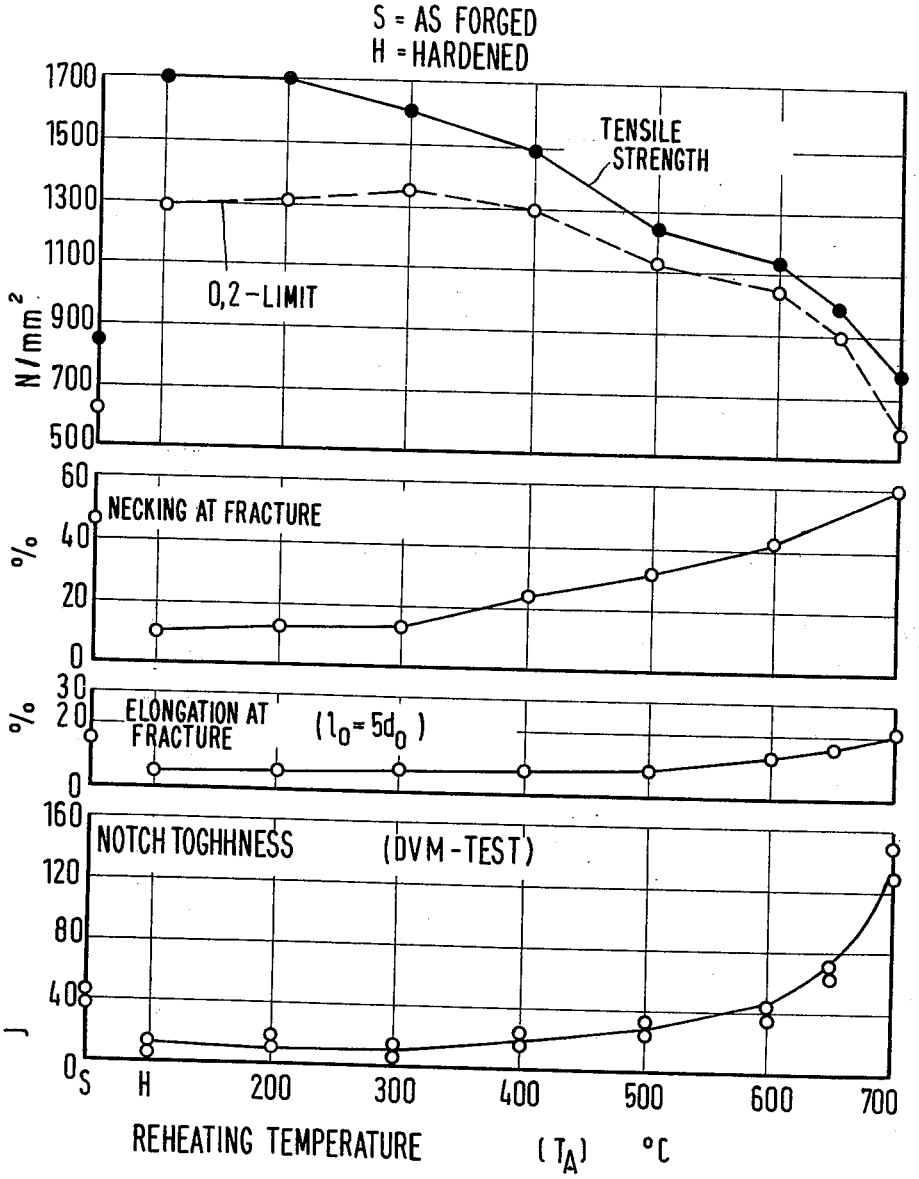

| | | COMPOSITION % | | | | | | | |
|---|---|---|---|---|---|---|---|---|---|
| | | C | Si | Mn | Cr | Mo | Ni | V | Nb |
| ▲ △ 30 CrNi Mo 8 | 840°C/ +T°C 2h/L | 0,33 | 0,24 | 0,43 | 1,98 | 0,25 | 1,98 | - | - |
| ● ○ MPS | 1100°C/ +T°C 2h/L | 0,43 | 0,32 | 0,93 | 0,30 | - | - | 0,10 | 0,03 |

QUENCH TEST OF MPS

AUSTENISATION AT 1100°C 0,5h

STEEL COMPOSTION: 0,4 %C; 0,3 %Si; 0,9 %Mn; 0,3 %Cr; 0,1 %V; 0,03 %Nb

HEAT-TREATABLE STEEL

This invention relates to the use of an alloy steel in the heat-treated state for the production of parts which after heat treatment retain their hardness and have a minimum tensile strength of 700 N/mm² and a notch toughness (DVM test) of at least 55 joules, and which have a lower alloy content than has hitherto been used.

For achieving the above specified properties steels hitherto used were alloyed with manganese, chromium and molybdenum, for instance a heat-treatable steel consisting of 0.15 to 0.4% C
1.1 to 1.9% Mn
0.06% S max.
0.05% P max.
0.1 to 1.0% Si
0 to 1.1% Cr
0.25% Ni max.
0.1 to 0.75% Mo, and
at least 0.0005% B,
balance Fe which steel possesses tensile strengths between 590 and 1080 N/mm² in the heat-treated state.

Another previously-known heat-treatable steel is a so-called 30CrNiMo8 steel of the following composition:

0.33% C
0.24% Si
0.43% Mn
1.98% Cr
0.25% Mo
1.98% Ni
balance Fe

The present invention is directed to a steel which is less highly alloyed than the above-mentioned known steels and hence is cheaper to produce while having the high values of strength and toughness as the previously known higher alloyed steels.

The invention is based on the surprising discovery that an addition of niobium in a specified range in conjunction with the choice of a suitable temperature of austenisation to enable a sufficient amount of niobium to be dissolved without permitting coarse grain to form, results in the achievement of values of strength and toughness otherwise attainable only by the above-mentioned higher alloyed known heat-treatable steels.

It is already known that an addition of 0.05% to 0.15% of vanadium or niobium to a carbon steel enables the 0.2 proof stress limit to be raised. However it was not previously realized that vanadium and niobium have entirely different effects on the transformation phenomena, and it has now been found that an addition of niobium in a specified quantity range delays the pearlite transformation so that an intermediate stage range is in fact present permitting the development after hardening of a structure consisting of martensite and intermediate stage, which structure then forms the basis for the improved strength and toughness values, the addition of vanadium does not have such an effect. If vanadium is added in quantities of about 0.1% no intermediate stage forms as when niobium is added. Since the former of the two known steels hereinbefore set forth has a pearlitic-ferritic structure, it does not attain the toughness values of the steel proposed for use contemplated by the invention.

Another feature of the steels according to the present invention is that an addition of niobium in a specified range can improve hardness penetration values so that the desired structure of martensite and intermediate stage will also develop in parts having major cross sections.

The invention provides a part made of an alloy steel consisting essentially of:

0.35% to 0.6% C
0.1% to 0.5% Si
0.3% to 1.0% Mn
0.1% to 0.6% Cr, and
0.01% to 0.1% Nb,
balance iron which after austenisation is rapidly cooled from temperatures above 1000° C. to form a structure consisting principally of martensite and intermediate stage and then reheated to below the $A_1$ critical temperature, whereby the said part retains its hardness, and has a minimum tensile strength of 700 N/mm² and a notch toughness (DVM test) of at least 55 joules.

By the term "consisting essentially" as used herein and in the claims hereof is meant that the steels may also contain impurities and incidental ingredients in such small proportions that the stated properties of the steel are not affected.

A preferred embodiment of the invention provides a part made of an alloy steel consisting essentially of:

0.4% to 0.5% C
0.2% to 0.4% Si
0.7% to 1.0% Mn
0.2% to 0.5% Cr
0.08% to 1.12% Vn, and
0.02% to 0.05% Nb
balance Fe which has been rapidly cooled from a temperature of about 1100° C. and reheated to between 650° C. and the $A_1$ temperature, whereby the said part has a minimum 0.2 proof stress limit of 550 N/mm², a minimum tensile strength of 750 N/mm² and a notch toughness (DVM test) of at least 60 joules.

FIG. 1 of the accompanying drawings is a plot of the strength and toughness values of a steel for use according to the invention, and having the composition specified at the heat of the diagrams. The diagrams show that even when reheated to only 650° C. an 0.2 limit of about 900 N/mm² and a notch toughness exceeding 60 joules (DVM test) is obtained.

Figure 2:
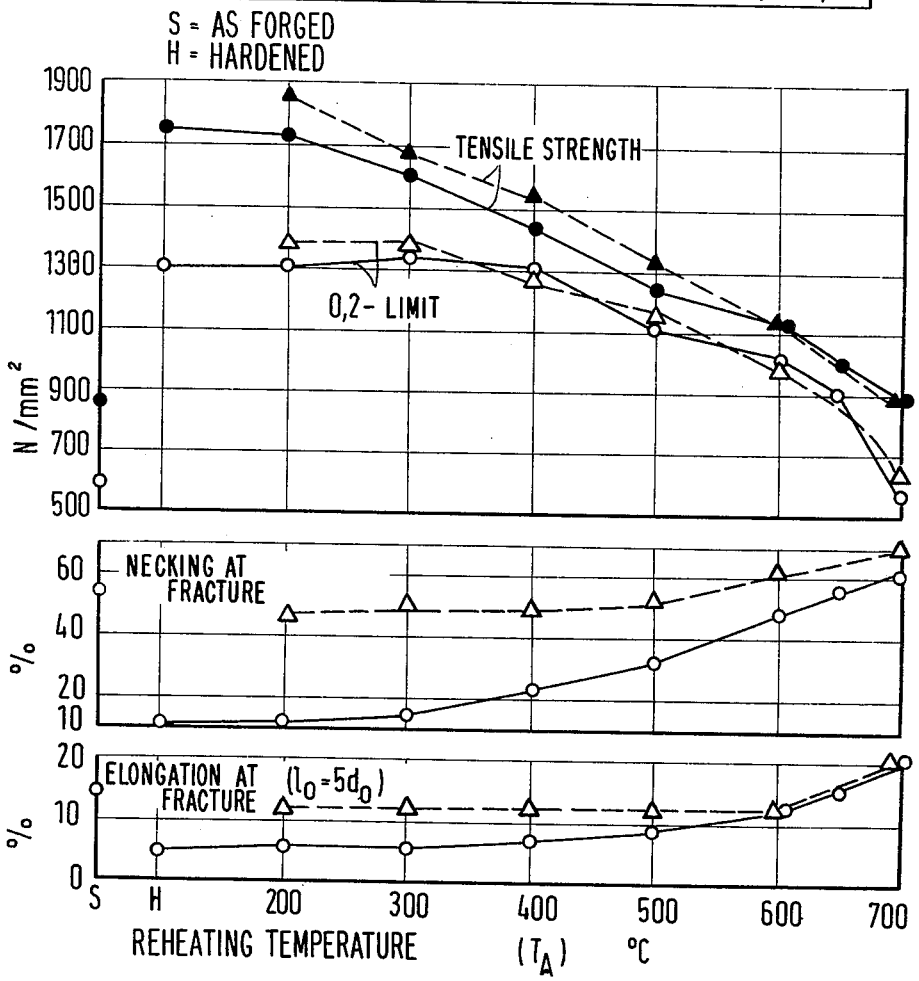

FIG. 2 shows that a steel according to the invention, designated MPS, and which has the composition specified therein, exhibits the same values of strength as the known higher alloyed and hence more expensive, heat-treated steel 30 CrNiMo8.

Figure 3:
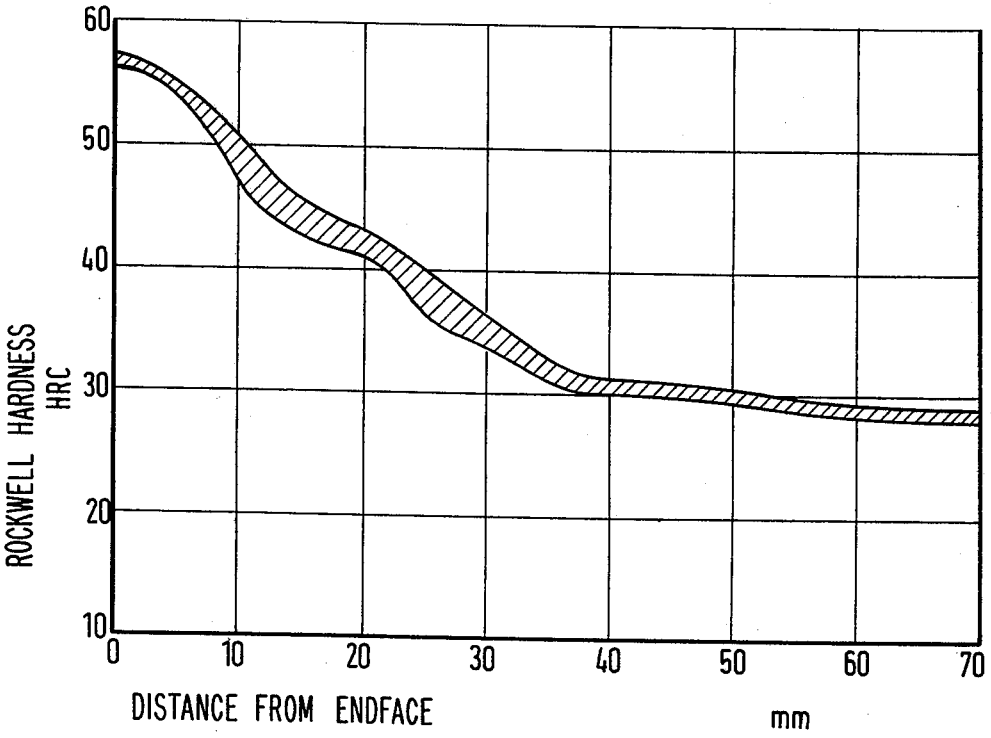

The hardnesses determined in an end quench test as shown in FIG. 3 of the accompanying drawings show that with a steel according to the invention significant hardness values are still obtained at a distance of about 20 mm from the end face of the test piece.

Legends in Figures:

FIG. 1: Tensile Strengths and Toughness Values of MPS

Dimensions: Dia 20 mm; test temperature RT
Hardening: 1100° C 30 min. in oil.
Steel containing 0.4% C, 0.3% Ci, 0.9% Mn, 0.3% Cr, 0.1% V; 0.03% Nb.
S = as forged.
H = hardened.

Zugfestigkeit = tensile strength.
0.2-Grenze = 0.2-limit.
Brucheinschnurung = necking at fracture.
Bruchdehnung = elongation at fracture.
Kerbschlagzahigkeit (DVM-Probe) = notch toughness (DVM test).
Anlasstemperatur = reheating temperature.
FIG. 2: Comparison of the Strengths of MPS and 30 CrNiMo8
Dimensions: Dia 20 mm; test temperature RT

| | | | | Composition in % | | | | | | |
|---|---|---|---|---|---|---|---|---|---|---|
| | | | | C | Si | Mn | Cr | Mo | Ni | |
| Δ | Δ | 30 CrNiMo 8 | 840° C/oil + T° C 2h/L | 0.33 | 0.24 | 0.43 | 1.98 | 0.25 | 1.98 | etc. |
| O | O | MPS | 1100° C/oil + T° C 2h/L | | | | etc. | | | |

FIG. 3: End Quench Test of MPS
Austenisation at 1100° C/0.5 *h*
Steel containing 0.4% C; 0.3% Si; 0.9% Mn; 0.3% Cr; 0.1% V; 0.03% Nb.
Harte in HRC = hardness in deg. Rc
Abstand von der Stirnflache in mm = distance from end face in mm.

What is claimed is:

1. A part made of an alloy steel consisting essentially of
0.35% to 0.6% C
0.1% to 0.5% Si
0.3% to 1.0% Mn
0.1% to 0.6% Cr, and
0.01% to 0.1% Nb
balance iron
which after austenisation is rapidly cooled from temperatures above 1000° C. to form a structure consisting principally of martensite and intermediate stage and then reheated to below the $A_1$ critical temperature, whereby the said part retains its hardness, and has a minimum tensile strength of 700 N/mm² and a notch toughness (DVM test) of at least 55 joules.

2. A part as claimed in claim 1, made of an alloy steel consisting essentially of
0.4% to 0.5% C
0.2% to 0.4% Si
0.7% to 1.0% Mn
0.2% to 0.5% Cr
0.08% to 1.12% V, and
0.02% to 0.05% Nb,
balance Fe
which has been rapidly cooled from a temperature of about 1100° C. and reheated to between 650° C. and the $A_1$ temperature, whereby the said part has a minimum 0.2 proof stress limit of 550 N/mm², a minimum tensile strength of 750 N/mm² and a notch toughness (DVM test) of at least 60 joules.

* * * * *